US007765659B2

(12) United States Patent
Tsukamoto

(10) Patent No.: US 7,765,659 B2
(45) Date of Patent: Aug. 3, 2010

(54) METHOD OF MANUFACTURING A LIQUID EJECTION HEAD

(75) Inventor: Ryuji Tsukamoto, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 609 days.

(21) Appl. No.: 11/364,082

(22) Filed: Mar. 1, 2006

(65) Prior Publication Data

US 2006/0197808 A1 Sep. 7, 2006

(30) Foreign Application Priority Data

Mar. 2, 2005 (JP) ..... 2005-057925

(51) Int. Cl.
*H04R 17/00* (2006.01)
*B21D 53/76* (2006.01)

(52) U.S. Cl. ..... 29/25.35; 29/890.1; 29/830; 347/70; 347/72; 156/89.12; 419/48

(58) Field of Classification Search ..... 29/25.35, 29/890.1, 830; 347/70, 71, 72; 156/89.11, 156/89.12, 89.18, 89.28; 419/5, 8, 48
See application file for complete search history.

(56) References Cited

U.S. PATENT DOCUMENTS 5,458,709 A * 10/1995 Kamezaki et al. ..... 156/89.18
6,036,798 A * 3/2000 Nishide et al. ..... 156/89.12
6,796,639 B2 * 9/2004 Sugahara ..... 347/71

FOREIGN PATENT DOCUMENTS

JP 06180326 A * 6/1994
JP 8-230181 A 9/1996
JP 2003-63017 A 3/2003
JP 2003-142750 A 5/2003

OTHER PUBLICATIONS

Machine Language Translation of JP 2003-063017.*

* cited by examiner

*Primary Examiner*—A. Dexter Tugbang
(74) *Attorney, Agent, or Firm*—Birch, Stewart, Kolasch & Birch, LLP

(57) ABSTRACT

A method of manufacturing a liquid ejection head includes a pressure chamber forming step of forming at least one of recess sections and through holes corresponding at least to the pressure chambers, in a plurality of calcined bodies obtained by calcining a plurality of ceramic green sheets; a piezoelectric body forming step of forming a plurality of films of piezoelectric bodies which constitute the piezoelectric elements by means of an aerosol deposition method, onto the calcined body corresponding to the diaphragm, of the plurality of calcined bodies; a laminating step of forming glass layers onto surfaces of the calcined bodies and arranging the calcined bodies to overlap each other; and a heating step of heating the arranged calcined bodies to a prescribed temperature, and simultaneously performing glass bonding of the calcined bodies and annealing of the piezoelectric bodies.

2 Claims, 7 Drawing Sheets

METHOD OF MANUFACTURING A LIQUID EJECTION HEAD

BACKGROUND OF THE INVENTION

1. Field of the Invention

The present invention relates to a liquid ejection head and a method of manufacturing a liquid ejection head, and more particularly, to a liquid ejection head having a laminated structure in which a plurality of plate members are arranged to overlap each other.

2. Description of the Related Art

There are print heads (liquid ejection heads) having a structure in which a plurality of plate members overlap each other, a pressure change being generated in ink accommodated in pressure chambers by means of the displacement of piezoelectric elements disposed on a diaphragm constituting at least one wall face of the pressure chambers, and ink droplets thereby being ejected from nozzles connected to the pressure chambers.

As a method for manufacturing a print head having a laminated structure of this kind, for example, there is a method in which recess sections or through holes corresponding to pressure chambers are processed in a plurality of ceramic green sheets, the green sheets are arranged to overlap each other, piezoelectric bodies are printed as paste onto the green sheet corresponding to the diaphragm, and the structure is then calcined together. Paste printing allows the formation of a highly dense pressurized film, which has high pressure resistance, but unless it is calcined at 900° C. or above, satisfactory properties are not obtained in the film. On the other hand, if an aerosol deposition (AD) method is used, then it is possible to obtain piezoelectric bodies having satisfactory properties, by annealing at a temperature of around 600° C. However, with the aerosol deposition method, it is difficult to form piezoelectric body films on a green sheet.

A method using aerosol deposition is known in which, as shown in FIG. 9, a plurality of ceramic green sheets are manufactured (step S110), fine recess sections or through holes corresponding to the pressure chambers are processed in the plurality of green sheets (step S112), the green sheets are arranged to overlap each other (step S114) and calcined (step S116), piezoelectric body films are formed by the aerosol deposition method on the ceramic sheet corresponding to the diaphragm (step S118), and finally, the piezoelectric bodies are annealed (step S120). The pressure chambers are formed at the completion of step S116.

However, in this method, there is a risk that the dimensional accuracy of the ink flow channels will decline due to lamination errors in the step of arranging the green sheets in step S114. Moreover, there is also a risk of a decline in the dimensional accuracy of the recess sections or through holes formed in the calcined sheets (ceramic sheets) obtained by calcining the green sheets in step S116, due to thermal contraction of the sheets. Furthermore, since the pressure chambers are formed at the completion of step S116, there is a problem in that it is difficult to form piezoelectric bodies by the aerosol deposition method onto the calcined green sheet corresponding to the diaphragm, which constitutes a wall of the pressure chambers.

Japanese Patent Application Publication No. 8-230181 discloses a piezoelectric unit in which titanium film and platinum film are formed by sputtering onto a silicon substrate, and a lead zirconate titanate (PZT) film of a prescribed shape is formed thereon by the aerosol deposition method and then calcined, whereupon gold electrodes are applied on top of the PZT film.

In this method, the piezoelectric units are bonded to the diaphragm or a cavity plate by means of adhesive; however, there is no discussion of the actual bonding method. When bonding together a plurality of plate members in order to manufacture a print head, it is common to use an epoxy type resin as the adhesive, but depending on the pressurization conditions and the temperature during bonding, the bonding strength may be insufficient, and the piezoelectric units are liable to peel away from the diaphragm or cavity plate, and hence reliability is low.

Japanese Patent Application Publication No. 2003-142750 discloses a method of manufacturing piezoelectric bodies patterned in an array configuration, by applying a silica ($SiO_2$) film to the whole surface of a stainless steel substrate by sputtering, layering an electrode-forming Ti film or Pt film over the whole surface thereof, forming a prescribed resist pattern thereon by photolithography, forming a PZT film (piezoelectric body film) on the substrate so as to cover the resist pattern by the aerosol deposition method, creating a further electrode-forming Ti film or Pt film thereon by sputtering, and finally, removing the resist by a lift-off process.

In this method, however, a resist pattern is formed, a PZT film is then formed, the PZT film on the resist is then removed with the resist in a lift-off step, the structure is then annealed, and holes are then opened in the rear surface of the stainless steel substrate by selective etching in order to form pressure chambers. Therefore, complicated steps are involved, and the process is time-consuming and costly.

Japanese Patent Application Publication No. 2003-63017 discloses a method (glass bonding method), in which thin glass films are formed on the surfaces of plate members which each have ink flow apertures (groove hole sections) that form a single ink flow channel when the plate members overlap each other, and the plate members are then arranged to overlap each other in such a manner that their respective ink flow apertures are partially coinciding, whereupon they are pressurized and heat-treated, thereby softening the thin glass films between the plate members and thus bonding the plate members together.

In this method, ferrite type stainless steel SUS 446, or an iron-nickel-cobalt alloy containing 29% of nickel and 17% of cobalt (product name: Cobal), or the like, is used as the material of the plate members on which thin glass substrates are formed, and the heating temperature during bonding of the plate members is 400° C. or below. Therefore, a problem arises in that the step requiring annealing at 600° C. or above, such as the formation of the piezoelectric body films by the aerosol deposition method, and the step of glass bonding, cannot be carried out simultaneously, and therefore, the overall process becomes complicated. In particular, if the plate members are made of ceramic green sheets, then as described previously, the green sheets undergo thermal contraction during calcining, and the dimensional accuracy of the recess sections or through holes formed in the green sheets declines. In particular, there is a problem in that, if the dimensional accuracy of the pressure chambers falls and variations arise in the volumes of the pressure chambers, due to thermal contraction of the ceramic, then this will affect ejection performance, such as the ejection volume and ejection speed, and the like, of the ink droplets ejected from the nozzles, thus leading to a decline in print quality.

SUMMARY OF THE INVENTION

The present invention has been contrived in view of the foregoing circumstances, an object thereof being to provide a liquid ejection head having good print quality, as well as simplifying the steps of manufacturing the liquid ejection head.

In order to attain the aforementioned object, the present invention is directed to a method of manufacturing a liquid ejection head comprising: a plurality of nozzles which eject liquid; a plurality of pressure chambers which are connected to the nozzles and are filled with the liquid; a diaphragm constituting at least one wall face of the pressure chambers; and a plurality of piezoelectric elements which are arranged on the diaphragm, each of the piezoelectric elements being displaced to generate pressure change in the liquid filled in each of the pressure chambers through the diaphragm, the method comprising: a pressure chamber forming step of forming at least one of recess sections and through holes corresponding at least to the pressure chambers, in a plurality of calcined bodies obtained by calcining a plurality of ceramic green sheets; a piezoelectric body forming step of forming a plurality of films of piezoelectric bodies which constitute the piezoelectric elements by means of an aerosol deposition method, onto the calcined body corresponding to the diaphragm, of the plurality of calcined bodies; a laminating step of forming glass layers onto surfaces of the calcined bodies and arranging the calcined bodies to overlap each other; and a heating step of heating the arranged calcined bodies to a prescribed temperature, and simultaneously performing glass bonding of the calcined bodies and annealing of the piezoelectric bodies.

According to the present invention, the recess sections or the through holes corresponding to the pressure chambers are processed in the plurality of calcined ceramic green sheets, and the sheets are then arranged to overlap each other and glass bonded, thereby forming the pressure chambers. Consequently, in contrast to a case where ceramic green sheets are arranged to overlap each other and calcined after processing recess sections or through holes corresponding to the pressure chambers, there is no reduction in the dimensional accuracy of the pressure chambers due to thermal contraction of the ceramics. Furthermore, since the glass bonding of the calcined bodies and the annealing of the piezoelectric bodies are carried out simultaneously, the steps of manufacturing the liquid ejection head are simplified and manufacturing costs can be reduced.

Preferably, the pressure chamber forming step comprises a nozzle forming step of forming the nozzles in at least one of the plurality of calcined bodies. According to this, it is possible to simplify the method of manufacturing a liquid ejection head, yet further.

In order to attain the aforementioned object, the present invention is also directed to a liquid ejection head, comprising: a plurality of nozzles which eject liquid; a plurality of pressure chambers which are connected to the nozzles and are filled with the liquid; a diaphragm constituting at least one wall face of the pressure chambers; and a plurality of piezoelectric elements which are arranged on the diaphragm, each of the piezoelectric elements being displaced to generate pressure change in the liquid filled in each of the pressure chambers through the diaphragm, the piezoelectric elements including a plurality of piezoelectric bodies being formed as films by means of an aerosol deposition method and being processed by annealing, wherein: partitions of the pressure chambers have a laminated structure made by arranging to overlap each other and glass bonding a plurality of calcined ceramic green sheets; and the glass bonding of the calcined ceramic green sheets and the annealing of the piezoelectric bodies are substantially-simultaneously performed by heating.

According to the present invention, there is no decline in the dimensional accuracy of the pressure chambers due to thermal contraction of the ceramics, and therefore, print quality can be improved.

According to the present invention, recess sections or through holes corresponding to pressure chambers are processed in a plurality of calcined ceramic green sheets, and the sheets are then laminated together and glass bonded, thereby forming pressure chambers. Consequently, in contrast to a case where ceramic green sheets are laminated together and calcined after processing recess sections or through holes corresponding to the pressure chambers, there is no reduction in the dimensional accuracy of the pressure chambers due to thermal contraction of the ceramics. Furthermore, since the glass bonding of the calcined bodies and the annealing of the piezoelectric bodies are carried out simultaneously, the steps of manufacturing the liquid ejection head are simplified and manufacturing costs can be reduced.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
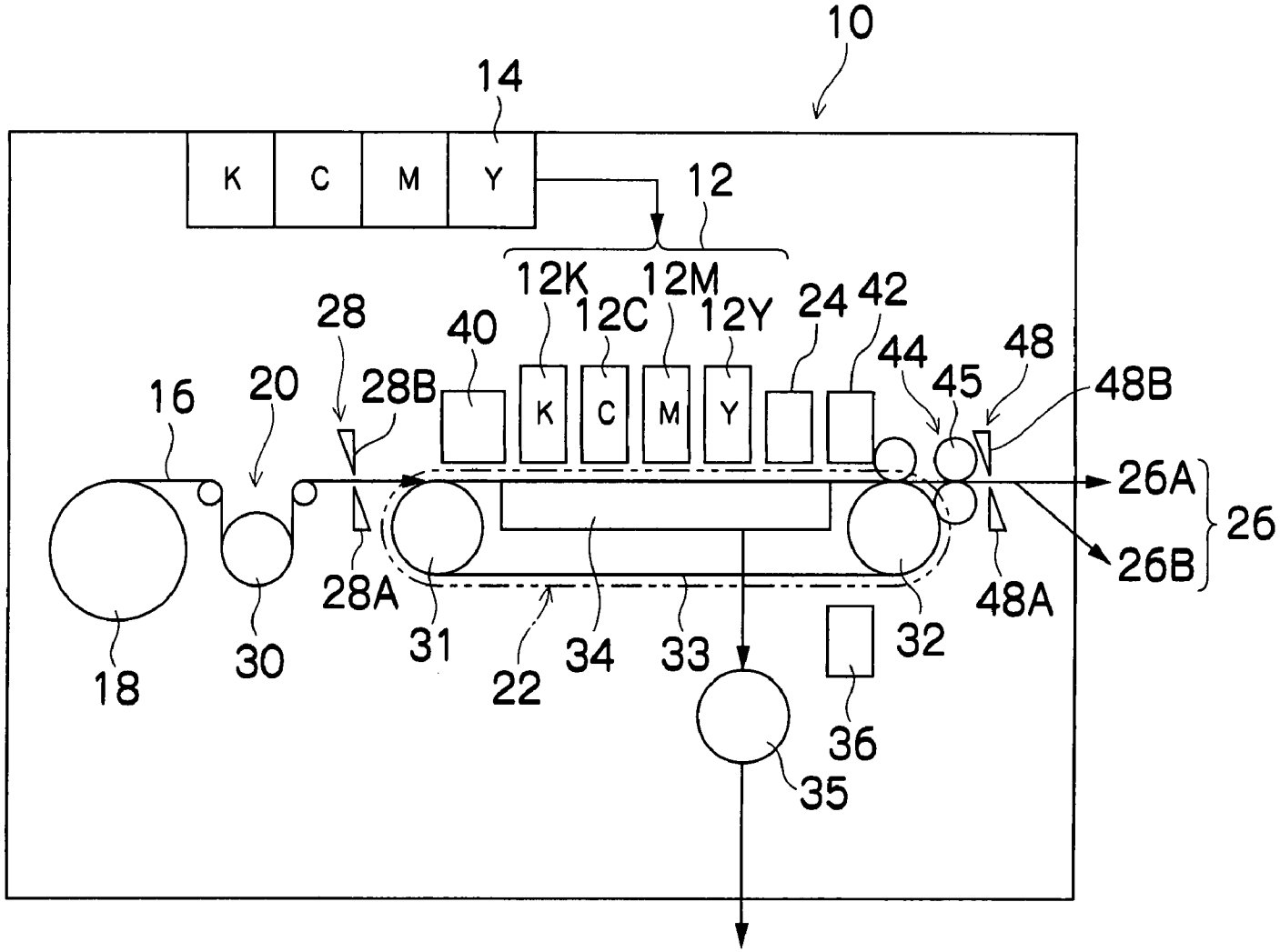
FIG. 1 is a general schematic drawing of an example of an inkjet recording apparatus.

FIG. 1 is a general schematic drawing of an inkjet recording apparatus forming one embodiment of an image forming apparatus to which the present invention is applied. As shown in FIG. 1, the inkjet recording apparatus 10 comprises: a print unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the print unit 12 on the interior side of the belt 33, which is set around the rollers 31 and 32, as shown in FIG. 1; and a negative pressure is generated by sucking air from the suction chamber 34 by means of a fan 35, thereby the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub-scanning direction).

More specifically, the print heads 12K, 12C, 12M and 12Y forming the print unit 12 are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, and 12Y are arranged in the order of black (K), cyan (C), magenta (M), and yellow (Y) from the upstream side (left side in FIG. 1), along the conveyance direction of the recording paper 16 (paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main scanning direction) which is perpendicular to the paper conveyance direction.

Here, the terms main scanning direction and sub-scanning direction are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the reference point is the sub-scanning direction and the direction perpendicular to same is called the main scanning direction.

Although a configuration with the KCMY four standard colors is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor (line sensor) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Structure of Print Head

Next, the structure of the print head will be described. The print heads 12K, 12C, 12M and 12Y of the respective ink colors have the same structure, and a reference numeral 50 is hereinafter designated to any of the print heads.

Figure 2:
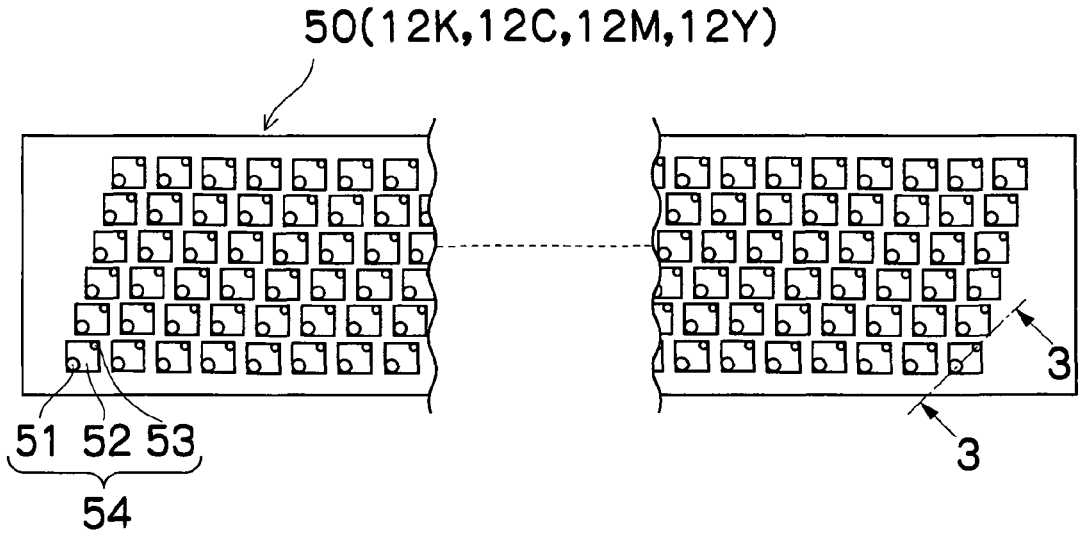
FIG. 2 is a plan perspective diagram showing an example of the structure of a print head.

FIG. 2 is a plan view perspective diagram showing an example of the structure of the print head 50. In order to achieve a high density of the dot pitch printed onto the surface of the recording medium, it is necessary to achieve a high density of the nozzle pitch in the print head 50. As shown in FIG. 2, the print head 50 according to the present embodiment has a structure in which a plurality of ink chamber units 54, each including a nozzle 51 which ejects ink droplets, a pressure chamber 52 corresponding to the nozzle 51, and the like, are two-dimensionally disposed in the form of a staggered matrix, and hence the effective nozzle interval (the projected nozzle pitch) as projected in the lengthwise direction of the print head 50 (the direction perpendicular to the paper conveyance direction) is reduced (high nozzle density is achieved).

The pressure chamber 52 provided corresponding to each of the nozzles 51 is approximately square-shaped in plan view, and the nozzle 51 and an ink supply port 53 are arranged at corners of the pressure chamber 52 on a diagonal of the pressure chamber 52.

Figure 3:
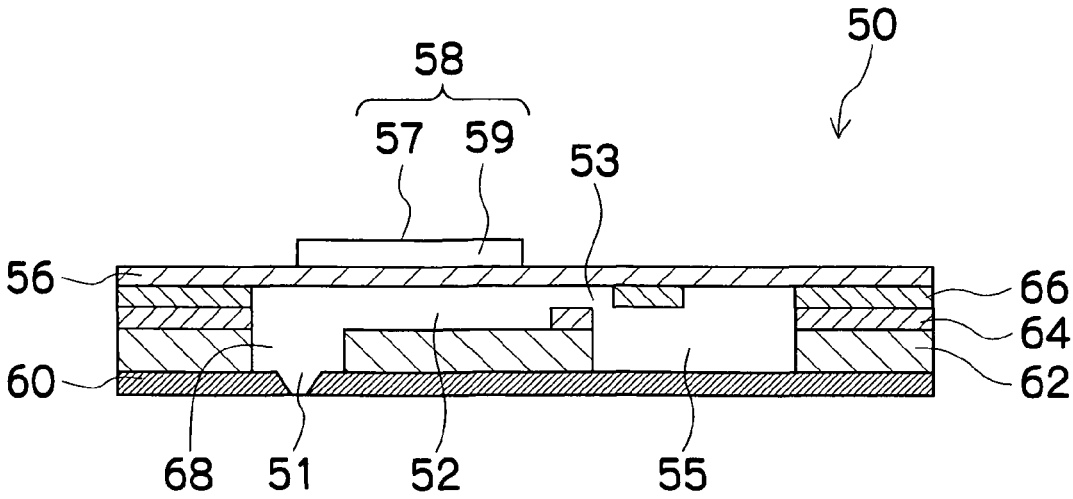
FIG. 3 is a cross-sectional diagram along line 3-3 in FIG. 2.

FIG. 3 is a cross-sectional diagram along line 3-3 in FIG. 2. As shown in FIG. 3, the print head 50 according to this embodiment has a structure in which a plurality of plate members are arranged to overlap each other. More specifically, five plates, namely, a nozzle plate 60, a nozzle flow channel plate 62, pressure chamber plates 64 and 66, and a diaphragm (vibration plate) 56, are arranged to overlap each other, in this order from the bottom up in FIG. 3. With the exception of the nozzle plate 60, the plate members (nozzle flow channel plate 62, pressure chamber plate 64 and 66, diaphragm 56) constitute the walls of the pressure chambers 52.

The nozzles 51 formed in the nozzle plate 60 are connected to the pressure chambers 52 through nozzle flow channels 68, and the pressure chambers 52 are also connected to a common liquid chamber 55 through the ink supply ports 53. The common flow channel 55 is connected to an ink tank (not shown), which is an ink source, and ink supplied from the ink tank is delivered to the pressure chambers 52 through the common liquid chamber 55.

Piezoelectric elements 58 comprising piezoelectric bodies 59 and individual electrodes 57 formed on the surface thereof are arranged on the diaphragm 56, which forms the ceiling (upper wall) of the pressure chambers 52 in FIG. 3. The diaphragm 56 also serves as a common electrode. The piezoelectric bodies 59 are formed by the aerosol deposition method as described hereinafter. When a drive voltage is applied to the individual electrode 57, the piezoelectric element 58 deforms, thereby changing the volume of the pressure chamber 52. This causes a pressure change in the pressure chamber 52 which results in a droplet of the ink being ejected from the nozzle 51. When ink is ejected, new ink is supplied to the pressure chamber 52 from the common flow channel 55 through the ink supply port 53.

Method of Manufacturing Print Head

Figure 4:
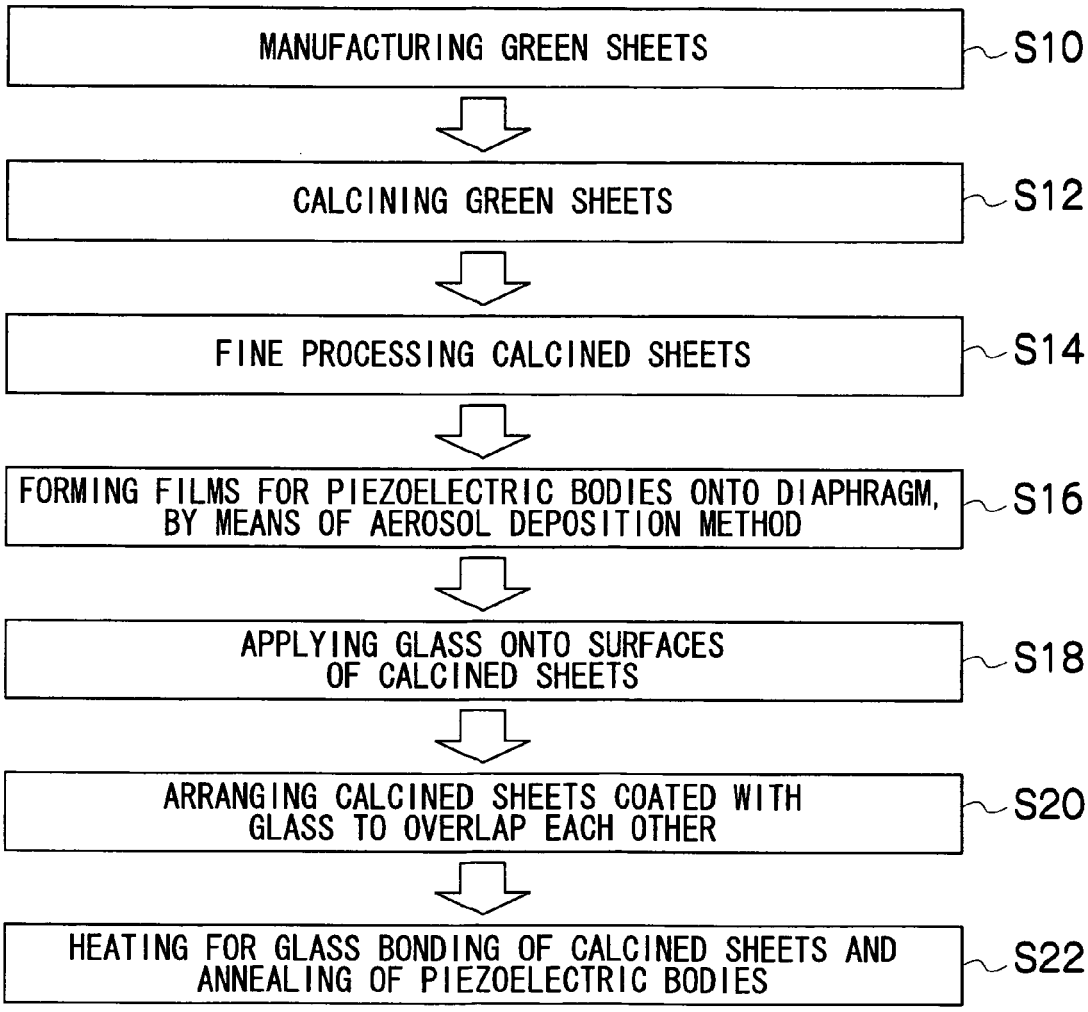
FIG. 4 is a flow diagram showing a sequence for the manufacture of a print head.

Next, a method of manufacturing the print head 50 is described with reference to FIG. 4 showing a flow diagram of the sequence of manufacture of the print heads 50. Here, in order to simplify the description, the method of manufacture is explained with respect to the print head 50 having the same laminated structure as that shown in the cross-sectional diagram in FIG. 3 and comprising one row of the nozzles 51 arranged one-dimensionally; however, the same description applies to a case where the nozzles 51 are arranged in a two-dimensional matrix as in FIG. 2.

Figure 5:
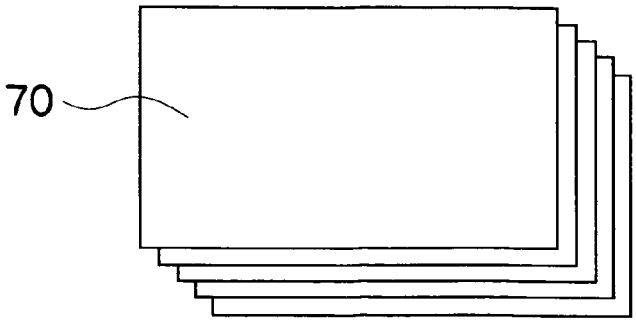
FIG. 5 is an illustrative diagram of ceramic sheets.

Firstly, a plurality of ceramic green sheets are manufactured (step S10). As a material for the ceramic, zirconia, alumina, aluminum nitride, silicon carbide, or the like, is used. Next, the green sheets manufactured at step S10 are separately calcined, thereby forming ceramic sheets (calcined sheets) (step S12). As shown in FIG. 5, five ceramic sheets 70 are manufactured in the present embodiment. These sheets correspond respectively to the nozzle plate 60, the nozzle flow channel plate 62, the pressure chamber plates 64 and 66, and the diaphragm 56 shown in FIG. 3.

Thereupon, fine processing is carried out with respect to the ceramic sheets 70 (step S14). FIGS. 6A to 6E are plan diagrams of the ceramic sheets 70 (70A, 70B, 70C, 70D and 70E) after fine processing. Below, the shapes of the ceramic sheets 70 in FIGS. 6A to 6E will be described briefly.

Figure 6A:
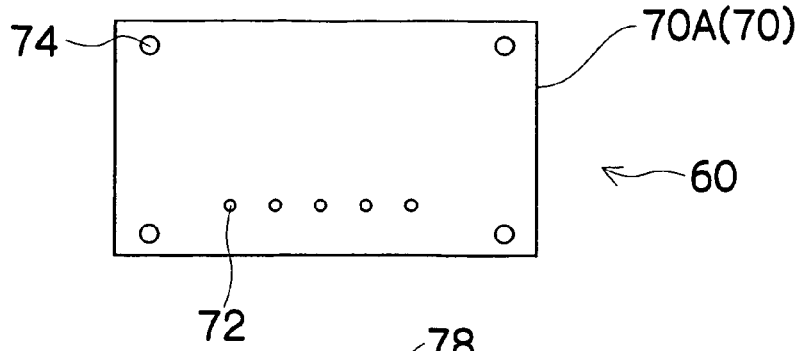
FIGS. 6A to 6E are plan diagrams of ceramic sheets after fine processing.

The ceramic sheet 70A in FIG. 6A corresponds to the nozzle plate 60, and is formed with five nozzle holes 72 corresponding to the nozzles 51 arranged at uniform intervals in one row in the lengthwise direction of the print head. Positioning holes 74 for positioning the sheet 70A with respect to the other ceramic sheets 70B to 70E are provided in corner sections of the ceramic sheet 70A.

Figure 6B:
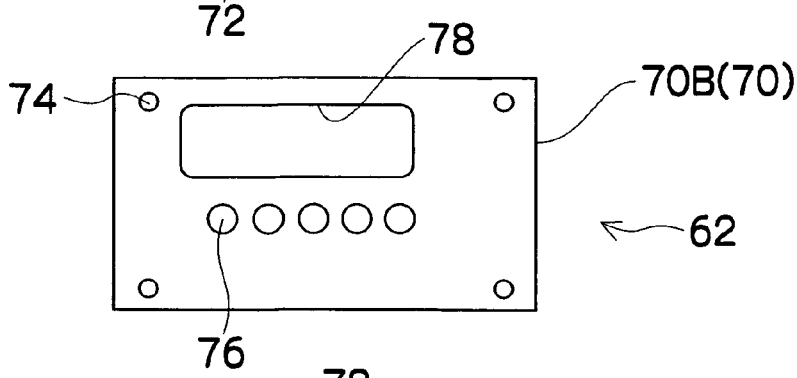

The ceramic sheet 70B in FIG. 6B corresponds to the nozzle flow channel plate 62, and is formed with nozzle flow channel holes 76 corresponding to the nozzle flow channels 68 (see FIG. 3) arranged at uniform intervals in one row in the lengthwise direction of the print head. The nozzle flow channel holes 76 are formed so as to correspond with the nozzle holes 72 in the ceramic sheet 70A. A rectangular common liquid chamber hole 78 is formed extending in the row direction of the positioning holes 74 and the nozzle flow channel holes 76. The common liquid chamber hole 78 constitutes a common liquid chamber 55 (see FIG. 3), in conjunction with the common liquid chamber holes 78 in the ceramic sheets 70C and 70D, as described below.

Figure 6C:
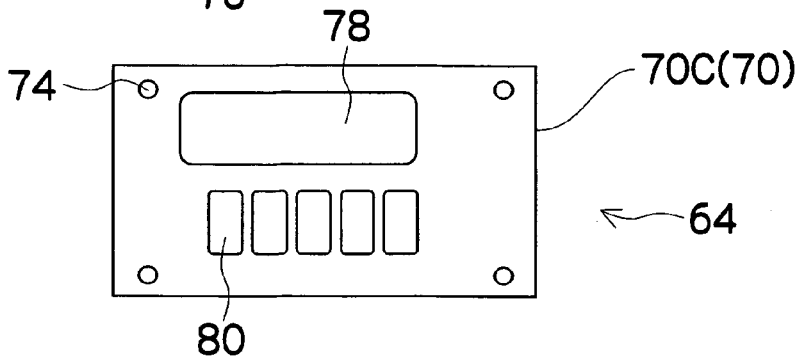

The ceramic sheet 70C in FIG. 6C corresponds to the pressure chamber plate 64, and is formed with pressure chamber holes 80 arranged at uniform intervals in one row in the lengthwise direction of the print head, so as to correspond with the nozzle holes 72 and the nozzle flow channel holes 76. The pressure chamber holes 80 correspond to the pressure chambers 52 (see FIG. 3), and are formed in a rectangular shape which extends in a direction perpendicular to the row direction of the pressure chamber holes 80. The positioning holes 74 and the common liquid chamber hole 78 are also formed, similarly to the ceramic sheet 70B.

Figure 6D:
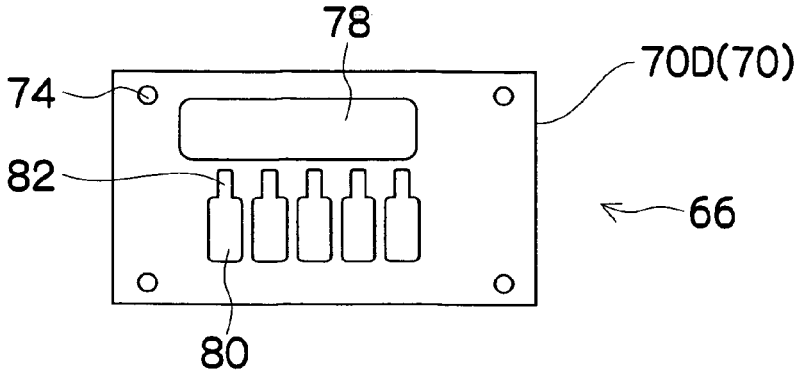

The ceramic sheet 70D in FIG. 6D corresponds to the pressure chamber plate 66, and similarly to the ceramic sheet 70C, it is formed with the pressure chamber holes 80, the common liquid chamber hole 78 and the positioning holes 74, and furthermore, long fine holes 82 extending toward the sides of the common liquid chamber hole 78 are formed integrally with the pressure chambers holes 80. These fine holes 82 correspond to the ink supply ports 53 (see FIG. 3).

Figure 6E:
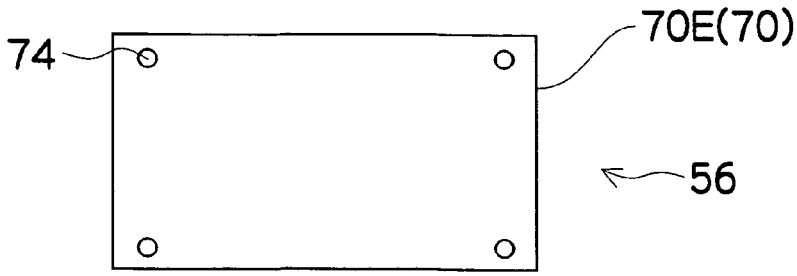

The ceramic sheet 70E in FIG. 6E corresponds to the diaphragm 56, and is formed with the positioning holes 74 at the corner sections thereof.

Figure 7:
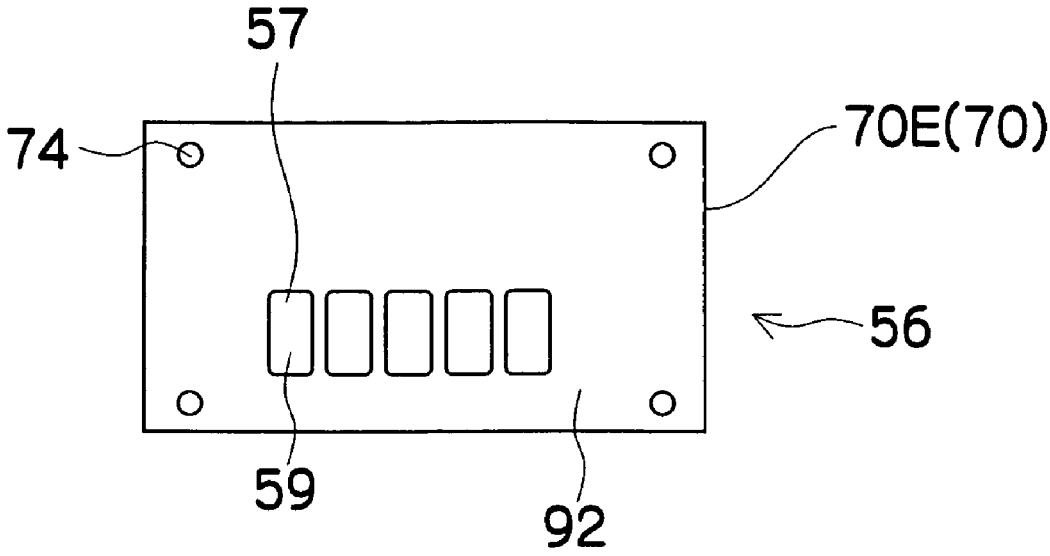
FIG. 7 is a plan diagram of a ceramic sheet showing a state after formation of piezoelectric body films.

After carrying out the fine processing with respect to the ceramic sheets 70 (70A through 70E) as described above, a common electrode 92 is formed on the whole surface of the ceramic sheet 70E corresponding to the diaphragm 56, the piezoelectric bodies 59 are formed by the aerosol deposition method on the common electrode 92, and furthermore, the individual electrodes 57 are formed on the surface of the piezoelectric bodies 59 (step S16). The common electrode 92 and the individual electrodes 57 are formed by screen printing, sputtering, vapor deposition, or the like. FIG. 7 is a plan diagram of the ceramic sheet 70E on which the films of the piezoelectric bodies have been formed. As shown in FIG. 7, the piezoelectric bodies 59 are formed on the common electrode 92 formed on the surface of the ceramic sheet 70E, at uniform intervals in a single row in the lengthwise direction of the print head, in such a manner that they correspond to the pressure chamber holes 80 of the ceramic sheets 70C and 70D (see FIGS. 6C and 6D), and furthermore, the individual electrode 57 is formed on the surface of each piezoelectric body 59.

Figure 8:
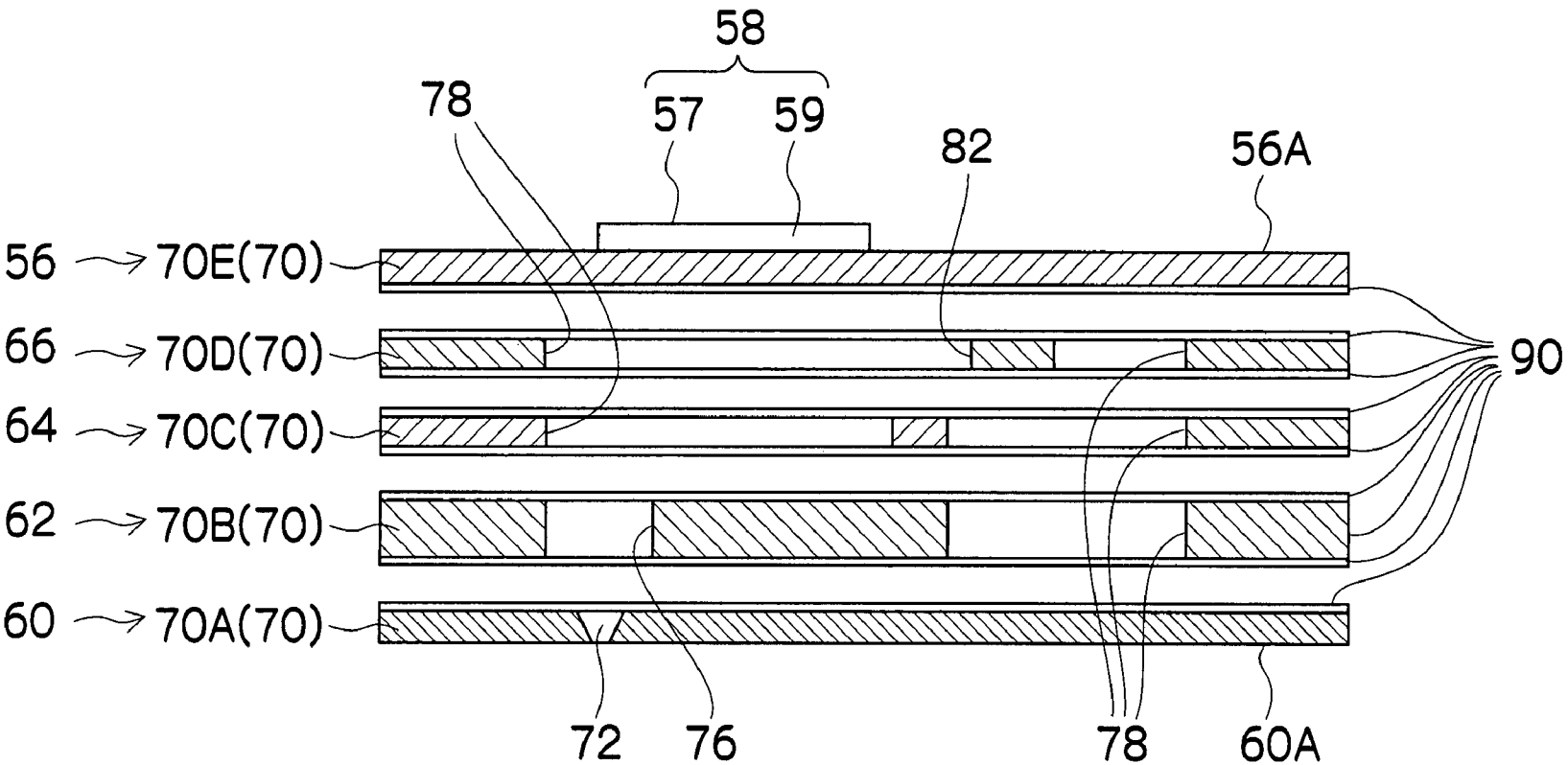
FIG. 8 is an illustrative diagram showing a situation where the ceramic sheets are arranged to overlap each other.
Figure 9:
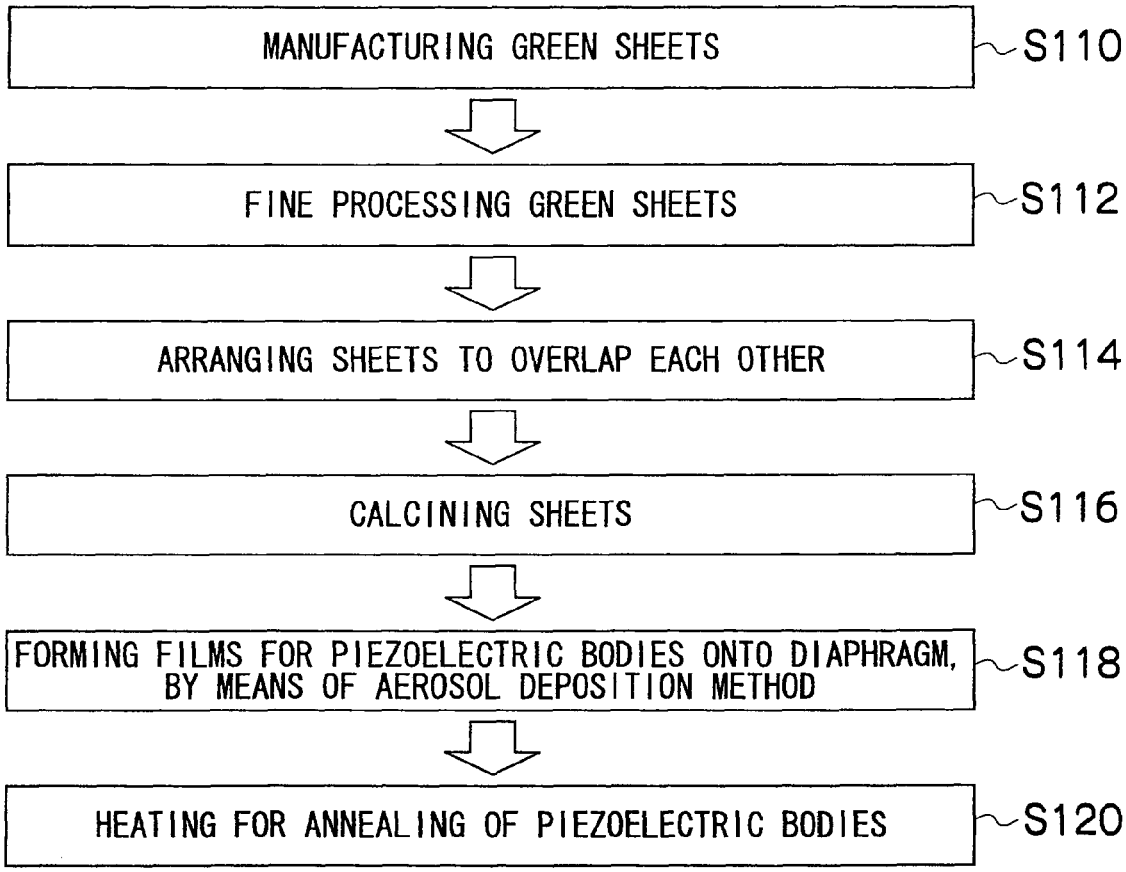
FIG.9 PRIOR ART
FIG. 9 is a flow diagram showing a sequence for the manufacture of a print head according to the related art.

Next, glass layers are formed on the surfaces of the ceramic sheets 70A through 70E which make contact with each other when the ceramic sheets 70A through 70E are arranged to overlap each other (step S18). FIG. 8 is an illustrative diagram showing a situation where the ceramic sheets 70 are arranged to overlap each other. As shown in FIG. 8, the glass layers 90 are formed on all of the surfaces of the ceramic sheets 70 (70A through 70E), with the exception of the ink ejection surface 60A facing in the ink ejection direction on the ceramic sheet 70A which corresponds to the nozzle plate 60, and the surface 56A of the ceramic sheet 70E corresponding to the diaphragm 56 on which the piezoelectric bodies 59 are formed. The glass layers 90 are thereby formed on both of the contact surfaces which oppose each other in the present embodiment; however, it is also possible to form the glass layer 90 on only one of the two opposing contact surfaces.

As a method of forming the glass layers on the surfaces of the ceramic sheets 70, a commonly known method described in Japanese Patent Application Publication No. 2003-63017 can be used. More specifically, an impregnation method, a screen printing method, a doctor blade method, a photo-spinning method, an electrophoresis application method, or the like, is appropriately used. Furthermore, it is also possible to bond thin glass plates processed to a prescribed shape on the surfaces of the ceramic sheets 70.

The material of the glass layers is preferably a glass that softens at the temperature required for annealing of the piezoelectric bodies 59 formed by the aerosol deposition method (i.e., 600° C. or above). In other words, the material of the glass layers includes at least one of $SiO_2$, PbO, $B_2O_3$ and $Al_2O_3$, and has a coefficient of thermal expansion similar to that of the ceramic material (e.g., zirconia, alumina, aluminum nitride, silicon carbide).

Desirably, a liquid-repelling treatment is applied on the ink ejection surface 60A of the ceramic sheet 70A corresponding to the nozzle plate 60. Thus, small liquid droplets, dirt, or the like, adhering to the nozzle surface 60A is removed readily by a blade, or the like, and hence ejection defects in the nozzles 51 can be prevented.

After forming the glass layers 90 on the surfaces of the ceramic sheets 70, the ceramic sheets 70 are arranged to overlap each other as shown in FIG. 8 (step S20). At this time, the positioning holes 74 of the ceramic sheets 70 (see FIGS. 6A to 6E) are used to arrange the ceramic sheets 70 in such a manner that the nozzle holes 72, the nozzle flow channel holes 76, the pressure chamber holes 80, the fine holes 82 and the common liquid chamber holes 78 in the ceramic sheets 70 are mutually superimposed in prescribed positions correctly, and it is thereby possible to prevent decline in the dimensional accuracy of the ink flow channels of the print head 50 (the pressure chambers 52, the common liquid chamber 55, the nozzles 51 and the like) due to positional displacement during lamination.

Next, the ceramic sheets 70 arranged to overlap each other as shown in FIG. 8 are heated to a prescribed temperature while being pressurized in the direction of lamination in air, and the ceramic sheets 70 are thereby bonded together by the glass layers and the piezoelectric bodies 59 formed by the aerosol deposition method are annealed (step S22). At this time, desirably, the heating temperature is a temperature which allows the glass bonding and annealing to be performed simultaneously, and hence is a temperature not lower than 600° C. and not higher than 1200° C. Accordingly, the glass layers on the surfaces of the ceramic sheets are bonded each other by heat, and the ceramic sheets 70 are bonded together. Furthermore, the piezoelectric bodies 59 are also annealed. Thereafter, the sheets are cooled slowly, and the print head 50 as shown in FIG. 2 is obtained as a result.

In the present embodiment, the fine recess sections and through holes corresponding to the ink flow channels of the print head 50 (the pressure chambers 52, the common liquid chamber 55, the nozzles 51, and the like) are processed in the ceramic sheets 70 obtained by calcining the ceramic green sheets, and the ink flow channels of the print head 50 are formed by arranging to overlap each other and bonding these ceramic sheets 70 together through the glass layers. Consequently, in contrast to a case where ceramic green sheets are arranged to overlap each other and calcined after processing recess sections or through holes corresponding to the ink flow channels, there is no reduction in the dimensional accuracy of the ink flow channels due to thermal contraction of the ceramics.

In particular, in the present embodiment, since the dimensional accuracy of the pressure chambers 52 is good, there is no variation of the pressure chambers 52 in their volume, and hence the ejection performance, such as the ejection volume or ejection speed of the ink droplets ejected from the nozzles 51, is uniform, and print quality can be improved. In particular, in a case where the nozzles 51 are formed to a high density, it is possible to suppress variation in the volume of the pressure chambers 52, and therefore print quality can be improved.

Moreover, in the present embodiment, since the glass bonding of the ceramic sheets 70 and the annealing of the piezoelectric bodies 59 formed as films by the aerosol deposition method, can be carried out simultaneously, the steps for manufacturing the print head 50 are simplified and manufacturing costs can be reduced.

Furthermore, in the present embodiment, by using the ceramic sheets 70, it is possible to carry out the annealing of the piezoelectric bodies 59, which is performed simultaneously with the glass bonding of the ceramic sheets 70, at a high temperature, and hence the properties of the piezoelectric bodies 59 formed as films by the aerosol deposition method, such as the d constant, the mechanical strength, withstanding voltage, and the like, can be improved readily. Furthermore, it also becomes possible to carry out other post-processing steps which involve a high-temperature processes, in addition to the annealing of the piezoelectric bodies.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of manufacturing a liquid ejection head comprising: a plurality of nozzles which eject liquid; a plurality of pressure chambers which are connected to the nozzles and are filled with the liquid; a diaphragm constituting at least one wall face of the pressure chambers; and a plurality of piezoelectric elements which are arranged on the diaphragm, each of the piezoelectric elements being displaced to generate pressure change in the liquid filled in each of the pressure chambers through the diaphragm, the method comprising:

a pressure chamber forming step of forming at least one of recess sections and through holes corresponding at least to the pressure chambers, in a plurality of calcined bodies obtained by calcining a plurality of ceramic green sheets before the pressure chamber forming step;

a piezoelectric body forming step of forming a plurality of films of piezoelectric bodies which constitute the piezoelectric elements by means of an aerosol deposition method, onto the calcined body corresponding to the diaphragm, of the plurality of calcined bodies;

a laminating step of forming glass layers onto surfaces of the calcined bodies and arranging the calcined bodies to overlap each other; and a heating step of heating the arranged calcined bodies to a prescribed temperature that is required for simultaneously performing glass bonding of the calcined bodies and annealing of the piezoelectric bodies.

2. The method as defined in claim 1, wherein the pressure chamber forming step comprises a nozzle forming step of forming the nozzles in at least one of the plurality of calcined bodies.

* * * * *